US010376063B2

(12) United States Patent
Donovan et al.

(10) Patent No.: US 10,376,063 B2
(45) Date of Patent: Aug. 13, 2019

(54) INTEGRATED LUMBAR AND HEAD TILT ASSEMBLY

(71) Applicant: L & P PROPERTY MANAGEMENT COMPANY, South Gate, CA (US)

(72) Inventors: Robert Dean Donovan, Mooreville, MS (US); Nikki White, Pontotoc, MS (US); Nick Yang, Jiaxing (CN); Derek Sun, Jiaxing (CN); Eric Shen, Jiaxing (CN)

(73) Assignee: L&P Property Management Company, South Gate, CA (US)

( * ) Notice: Subject to any disclaimer, the term of this patent is extended or adjusted under 35 U.S.C. 154(b) by 340 days.

(21) Appl. No.: 15/438,987

(22) Filed: Feb. 22, 2017

(65) Prior Publication Data

US 2018/0235370 A1 Aug. 23, 2018

(51) Int. Cl.
*A47C 7/38* (2006.01)
*A47C 7/46* (2006.01)

(52) U.S. Cl.
CPC ..... *A47C 7/38* (2013.01); *A47C 7/462* (2013.01)

(58) Field of Classification Search
CPC .. A47C 1/036; A47C 7/38; A47C 7/46; A47C 7/462; B60N 2/66; B60N 2/6673
See application file for complete search history.

(56) References Cited

U.S. PATENT DOCUMENTS

| | | | | |
|---|---|---|---|---|
| 5,547,259 | A | 8/1996 | Fredrick | |
| 6,530,622 | B1 * | 3/2003 | Ekern | B60N 2/2222 297/284.1 |
| 8,807,651 | B2 * | 8/2014 | LaPointe | A47C 7/50 297/284.4 |
| 9,282,827 | B1 * | 3/2016 | Lu | A47C 7/38 |
| 9,949,567 | B2 * | 4/2018 | Sigmon | A47C 1/02 |
| 10,104,977 | B2 * | 10/2018 | Li | A47C 1/0242 |
| 2005/0242634 | A1 | 11/2005 | Serber | |
| 2007/0106188 | A1 * | 5/2007 | Walker | A61F 5/028 602/19 |
| 2016/0227934 | A1 * | 8/2016 | Lu | F16H 21/44 |
| 2016/0367033 | A1 * | 12/2016 | Sigmon | A47C 1/02 |
| 2017/0360201 | A1 * | 12/2017 | Brown | A47C 1/0242 |

FOREIGN PATENT DOCUMENTS

| | | | | |
|---|---|---|---|---|
| EP | 1632389 | A2 | 3/2006 | |
| EP | 3184000 | A1 * | 6/2017 | A47C 7/462 |
| WO | 2014195544 | A1 | 12/2014 | |
| WO | WO-2016049420 | A1 * | 3/2016 | A47C 1/02 |
| WO | WO-2016130336 | A1 * | 8/2016 | A47C 7/38 |
| WO | WO-2018214118 | A1 * | 11/2018 | A47C 7/38 |

OTHER PUBLICATIONS

Patent Cooperation Treaty Search Report and Written Opinion dated Mar. 12, 2018 in PCT Application No. PCT/US17/68406, 7 pages.

* cited by examiner

*Primary Examiner* — Ryan D Kwiecinski

(74) *Attorney, Agent, or Firm* — Shook Hardy & Bacon, LLP

(57) ABSTRACT

An integrated assembly is provided with both an adjustable lumbar support and a head tilt. The assembly is easily installed on any of a number of different seating units, and can be adjusted to accommodate seating units with a variety of back widths, and heights.

9 Claims, 8 Drawing Sheets

INTEGRATED LUMBAR AND HEAD TILT ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention relate to lumbar and head tilt mechanisms, and particularly to an integrated, adjustable lumbar and head tilt assembly, for use on a variety of seating units.

BACKGROUND OF THE INVENTION

Conventional recliner chairs typically incorporate mechanisms to move the chair into three basic positions: closed, with the footrest retracted and the back generally upright; a "TV position," with the footrest extended and the back generally upright; and reclined, with the footrest extended and the back in a reclined position.

One feature that may add to the comfort of users of these conventional recliners is a moveable headrest. The moveable headrest feature allows the head portion of the chair back to pivot with respect to the remainder of the back. This may increase the comfort of a person, especially in the reclined position, as rotation of the headrest supports the head of the user and can be adjusted to the most comfortable position. Another feature that may add to the comfort of users is an adjustable lumbar support.

While moveable headrests and lumbar supports have been provided in the past, it is desirable to provide an adjustable assembly, capable of installation on any number of styles of chairs, that provides an integrated lumbar support and head tilt.

BRIEF DESCRIPTION OF THE INVENTION

An integrated assembly is disclosed that provides both an adjustable lumbar support and a head tilt. The assembly is easily installed on any of a number of different seating units, and can be adjusted to accommodate seating units with a variety of back widths, and heights.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
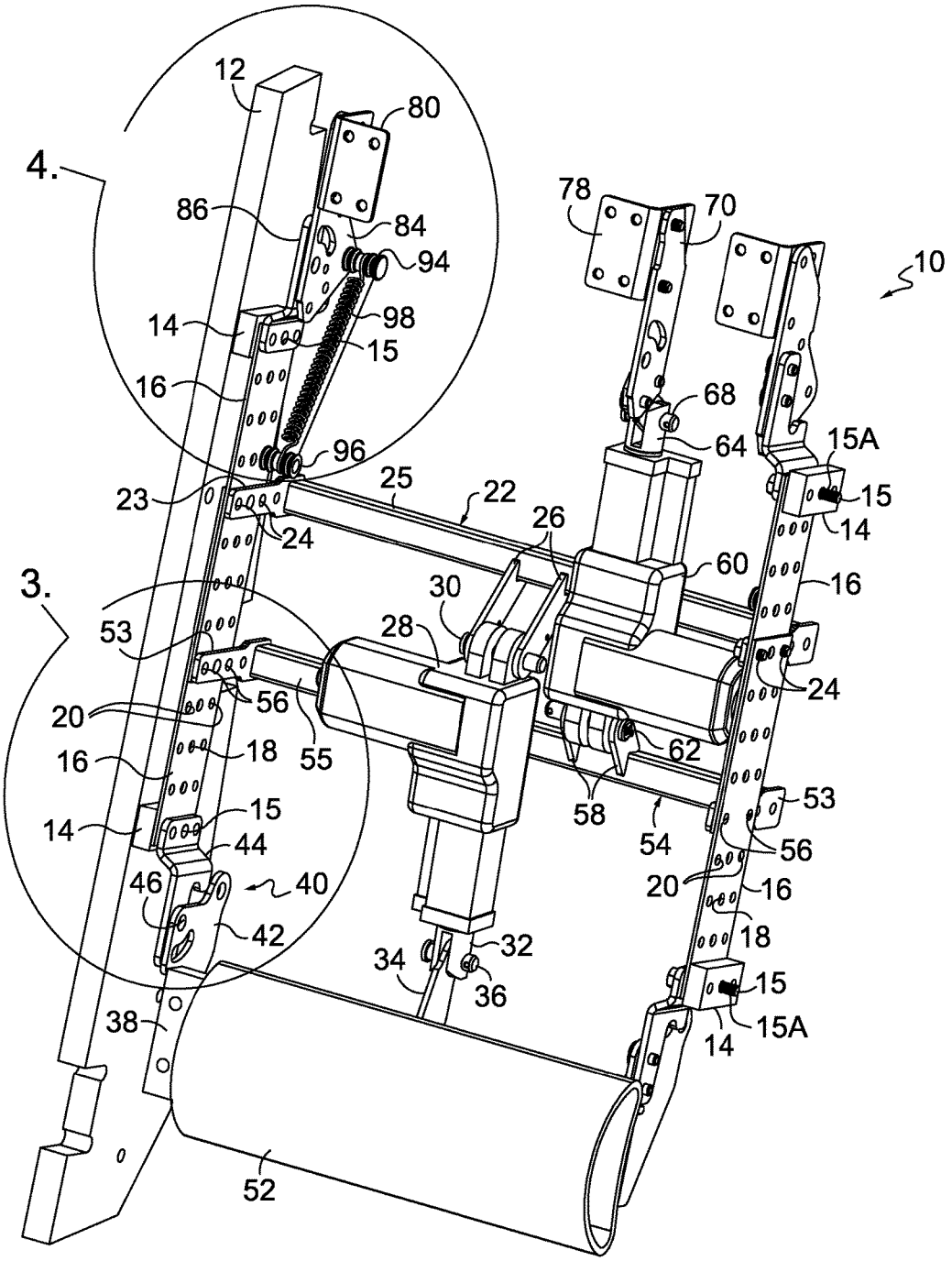
FIG. 1 is a perspective view of an exemplary integrated lumbar and head tilt assembly in a closed position, with only a portion of a chair frame shown for clarity, in accordance with an embodiment of the invention.

Embodiments of the present invention generally relate to an assembly that has an adjustable lumbar support and a head tilt mechanism for use on a recliner chair or other item of furniture. With initial reference to FIG. 1, an exemplary assembly 10 is shown. For ease of discussion, the assembly 10 is shown with one side 12 of a back frame. In practice, the back frame has two sides, and is finished with fabric, padding, etc., as known by those of skill in the art. The assembly 10 is spaced from, and coupled to, the back frame with four mounting blocks 14 and four bolts 15. Each side of assembly 10 has a pair of side plates 16 that are used as an adjustable frame for the remainder of the assembly 10. Each side plate 16 has a series of spaced holes. The middle mounting holes 18 are used to couple the side plates, and thus the assembly 10, to the side 12 of the back frame through the mounting blocks 14, using bolts 15, as more fully described below. The outer and inner holes 20 are used to mount other hardware, described below, to the side plates 16. The side plates 16 are moveable relative to one another to allow the head tilt and lumbar support to be properly positioned in any of a number of chairs with backs of varying height.

Figure 2:
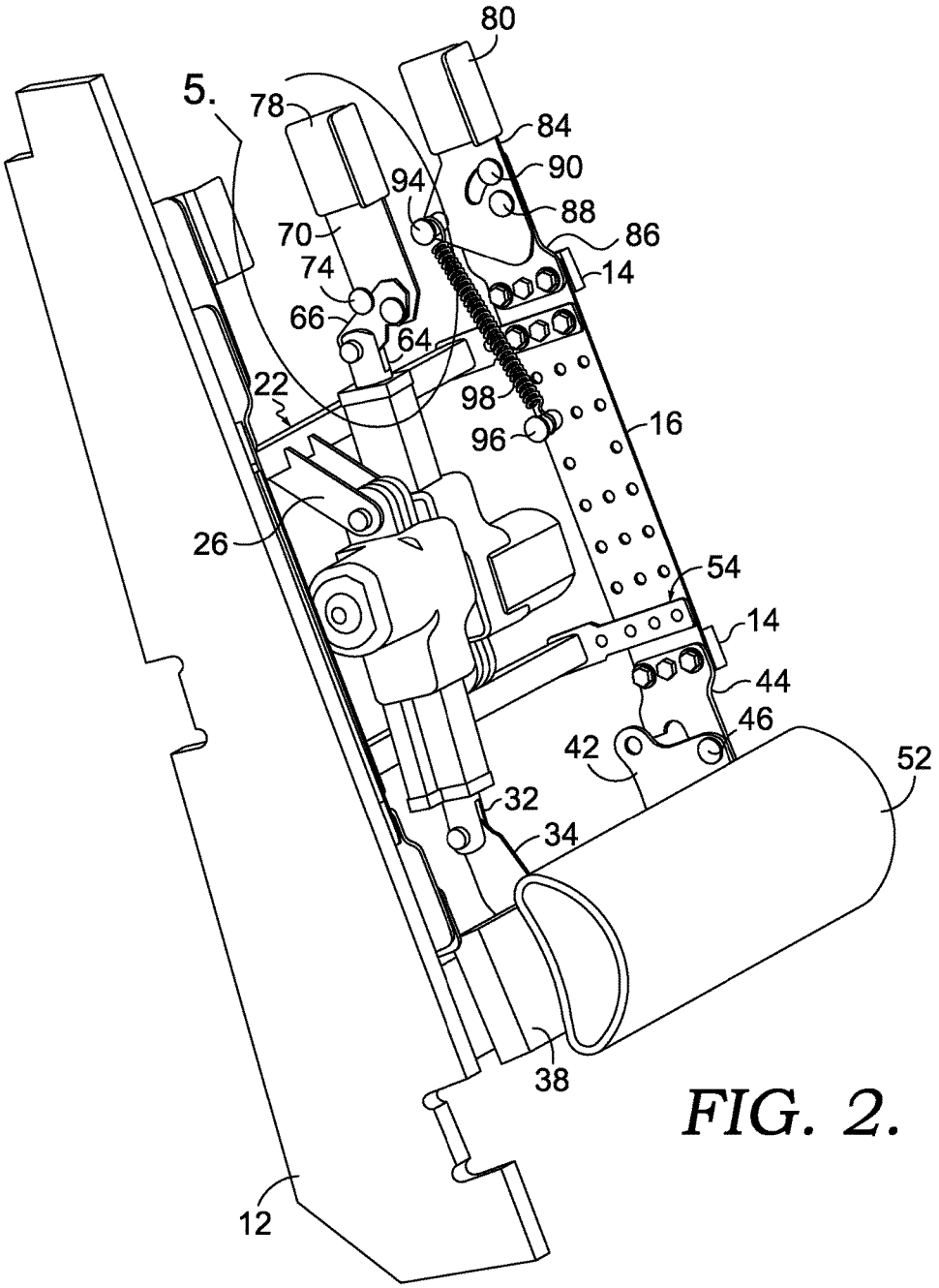
FIG. 2 is a perspective view similar to FIG. 1, from a different angle.
Figure 3:
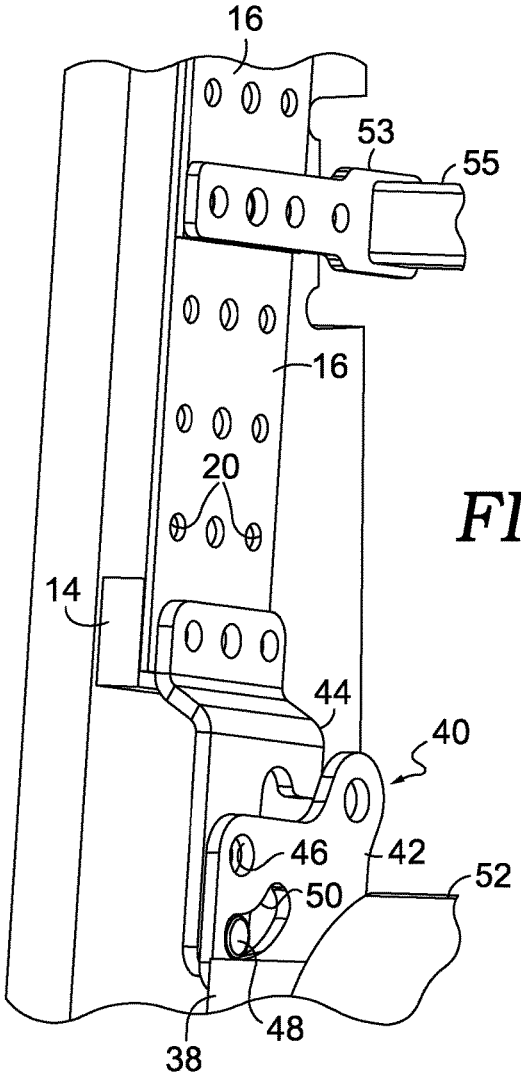
FIG. 3 is an enlarged, perspective view of a portion of the assembly of the encircled area 3 of FIG. 1.

More specifically, as best seen in FIG. 1, a lumbar motor tube assembly 22 is bolted on each side to side plate 16, using holes 20 with bolts 24. The lumbar motor tube assembly 22 includes a pair of spaced end plates 23, coupled to a central tube 25. The lumbar motor tube assembly 22 thus spans opposing side plates 16. A pair of motor mounting links 26 is rigidly secured to the lumbar motor tube assembly 22, at about the midpoint. As one example, the mounting links 26 can be welded to lumbar motor tube assembly 22. The motor mounting links 26 each have a hole in the outer end, which is used to couple a lumbar motor 28 to the motor mounting links 26 using a clevis pin 30. Lumbar motor 28 has an extendable/retractable shaft 32 that is pivotably coupled to a lumbar push link 34, such as, for example, with a clevis pin 36. As best seen in FIG. 2, the lumbar push link 34 is coupled to a lumbar push board 38, near the center of push board 38. Push board 38 extends horizontally, generally between the side plates 16. In at least some aspects, a lumbar push bar 52 is coupled to the lumbar push board 38. Lumbar push bar 52 may extend across some, or all, of the length of lumbar push board 38. Each outer end of push board 38 is coupled to a lumbar side assembly 40. Each lumbar side assembly 40 has a hinge plate 42 that is pivotably coupled to a pivot point link 44 at pivot point 46. As best seen in FIG. 3, the hinge plate 42 may also be guided in movement by a pin 48 that extends through a curved slot 50 in hinge plate 42, with the pin 48 being rigidly secured to pivot point link 44. The upper ends of pivot point links 44 are coupled to side plates 16, using holes 20, and may also be coupled to mounting block 14, depending on the location of the side plates 16, and the lumbar support. In use, the lumbar motor may be activated, such as by a push button, remote, or other device, to extend or retract the shaft 32. As shaft 32 extends or retracts, the lumbar push board 38 (and lumbar push bar 52, if attached) is rotated outwardly or inwardly, respectively, pivoting about point 46.

Figure 4:
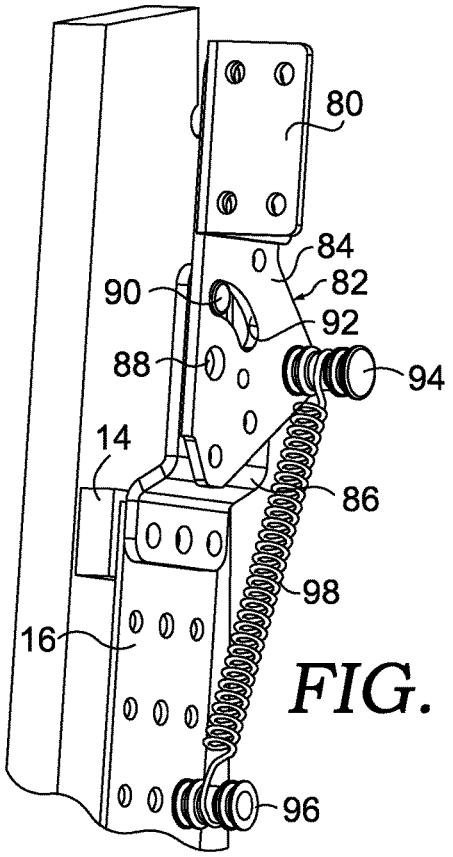
FIG. 4 is an enlarged, perspective view of a portion of the assembly of the encircled area 4 of FIG. 1.
Figure 5:
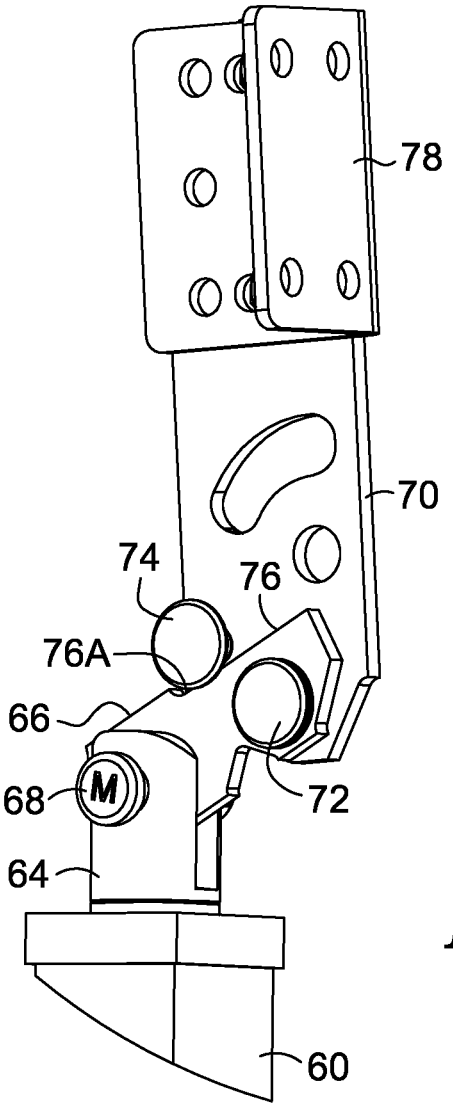
FIG. 5 is an enlarged, perspective view of a portion of the assembly of the encircled area 5 of FIG. 2.

Assembly 10 also includes a head tilt motor tube assembly 54 that is bolted on each side to an adjacent side plate 16, using holes 20, with bolts 56. The head title motor tube assembly 54 includes a pair of spaced end plates 53 coupled to a central tube 55. The head tilt motor tube assembly 54 thus spans opposing side plates 16. A pair of motor mounting links 58 is rigidly secured to the head tilt motor tube assembly 54, at about the midpoint. As one example, the mounting links 58 can be welded to head tilt motor tube assembly 54. The motor mounting links 58 each have a hole in the outer end, which is used to couple a head tilt motor 60 to the motor mounting links 58 using a clevis pin 62. As best seen in FIG. 5, head tilt motor 60 has an extendable/retractable shaft 64 that is pivotably coupled to one end of a safety link 66 at pivot 68. The other end of the safety link 66 is pivotably coupled to a pivot link 70 at pivot point 72. Near pivot point 72, a push rivet 74 is coupled to, and extends from, the pivot link 70. The push rivet 74 abuts a stop surface 76 on the top of safety link 66. A flange bracket 78 is rigidly secured (such as by bolting) to the upper end of the pivot link 70. Similarly, as best seen in FIG. 4, each side of the assembly 10 has a flange bracket 80 bolted to a head tilt side assembly 82. Each side assembly 82 has a hinge plate 84 that is pivotably coupled to a pivot point link 86 at pivot point 88. The hinge plate 84 is also coupled to pivot point link 86 with a pin or rivet 90 that is rigidly coupled to pivot point link 86, and that extends through a curved slot 92 in hinge plate 84. The lower ends of each pivot point link 86 are rigidly coupled to an adjacent side plate 16, using holes 20, and may also be coupled to mounting block 14, depending on the location of the side plates 16, and the head tilt. As best seen in FIG. 4, an upper spring bushing 94 is coupled to hinge plate 84. A lower spring bushing 96 is coupled to one of the side plates 16. An extension spring 98 is coupled to and between the spring bushings 94 and 96.

Figure 6:
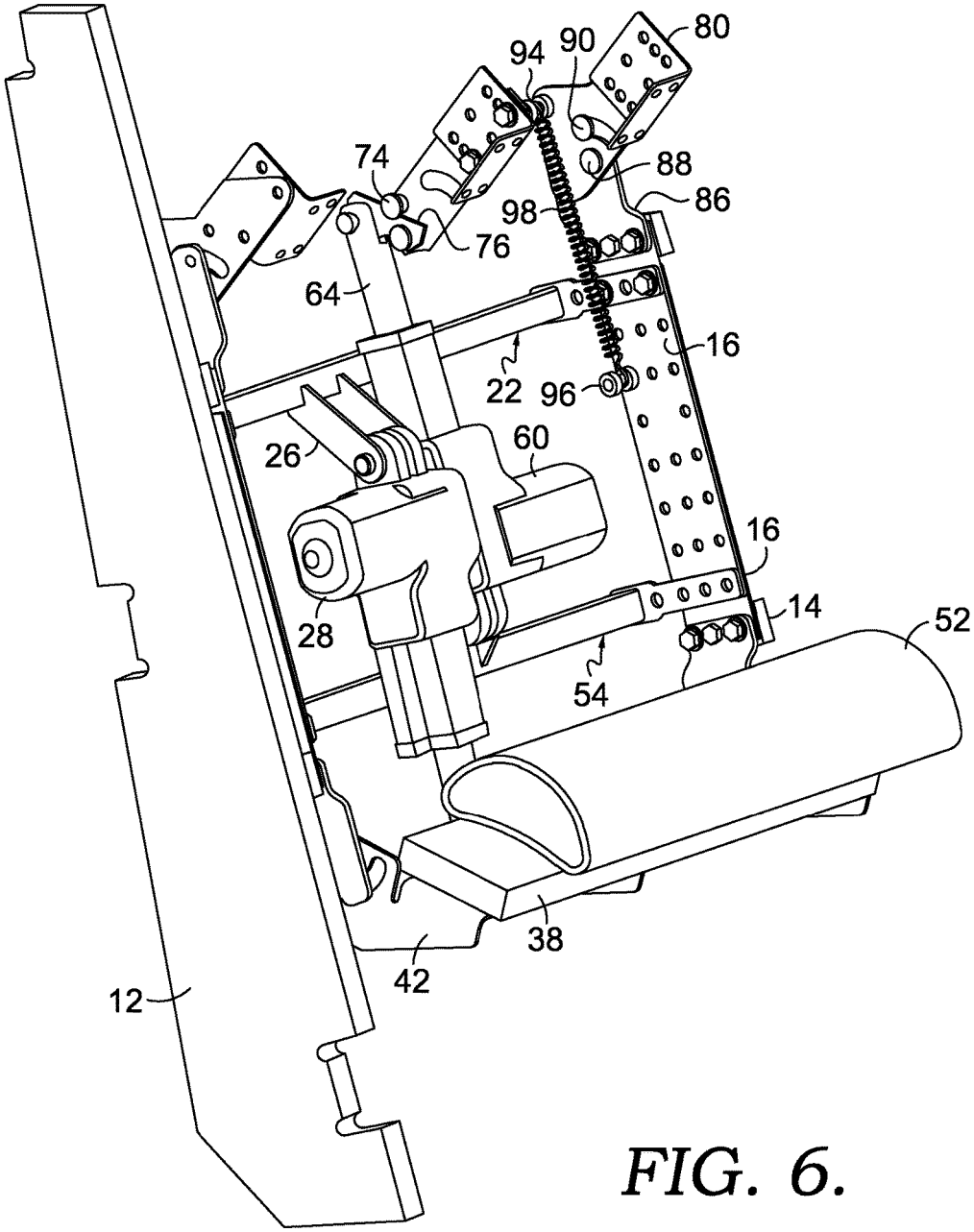
FIG. 6 is a perspective view similar to FIG. 2, but showing the lumbar and head areas in the fully extended or open positions.
Figure 7:
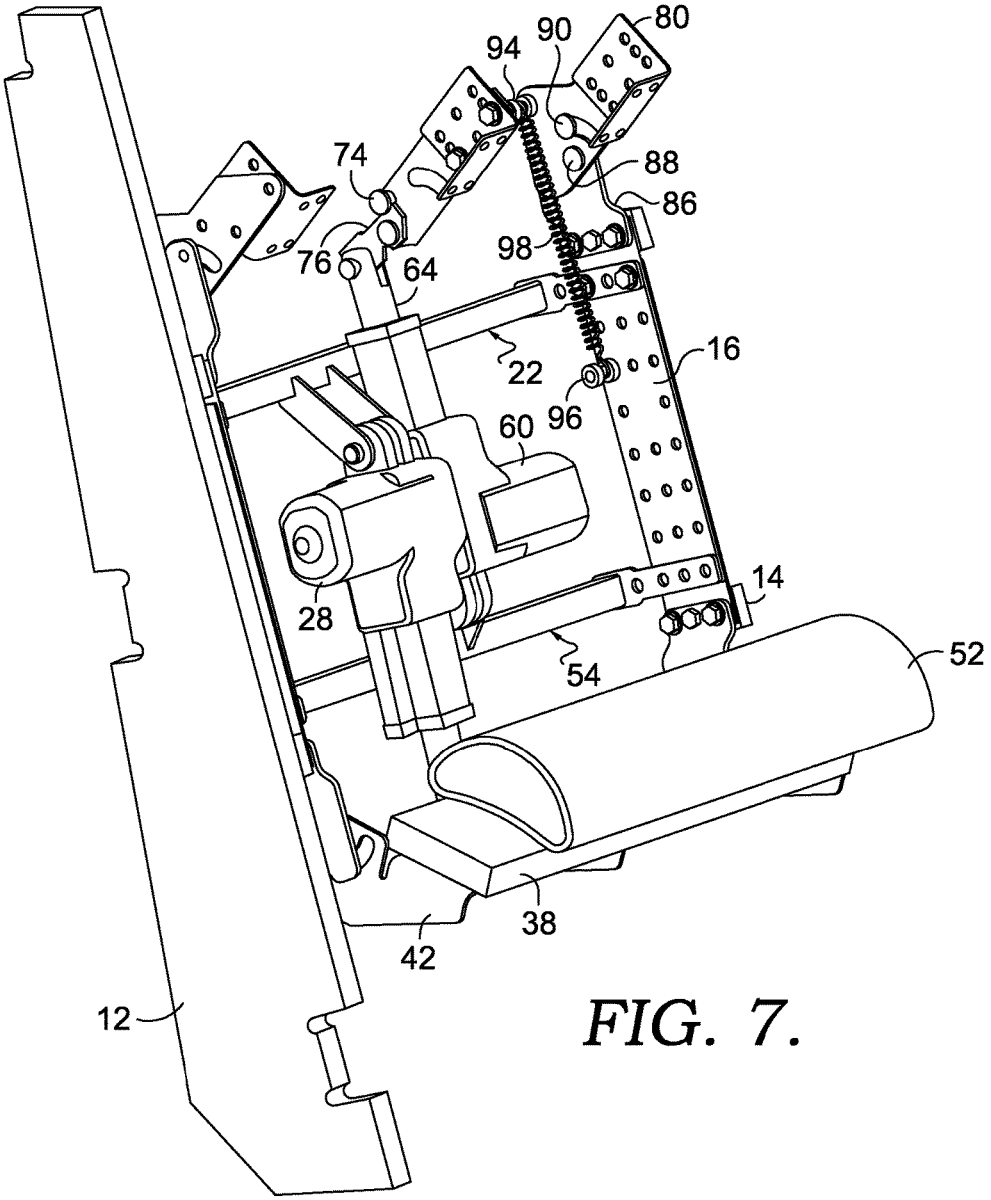
FIG. 7 is a view similar to FIG. 6, showing the relief mechanism engaged.

In use, the head tilt motor may be activated, such as by a push button, remote, or other device, to extend or retract the shaft 64. As shaft 64 extends, the stop surface 76 of the safety link 66 pushes against the push rivet 74. This operates to rotate pivot link 70 about the pivot point 72, and rotating hinge plates 84 about pivot point 88 on pivot point links 86. Therefore, extension of the shaft 64 on head tilt motor 60 operates to pivot the head area of the seating unit outwardly. In this condition, the pin 90 is in the rearward area of curved slot 92, as best seen in FIG. 6. To retract the head area, the head tilt motor 60 is activated to retract shaft 64. As shaft 64 retracts, the springs 98 rotate the hinge plates 84 and the pivot link 70 to return the head area to a closed position. If an object of some kind interferes with this retraction, the hinge plates 84 and the pivot link 70 have only the force of springs 98 acting on the object. The safety link 66 allows the shaft to continue to retract while the pivot link is blocked. In this position, safety link 66 rotates stop surface 76A away from push rivet 74, as seen in FIG. 7. Therefore, the head tilt has a relief mechanism, in the event that an object interferes with rotation of the hinge plates 84 or the pivot link 70. Once the interference is cleared, the springs 98 will return the hinge plates 84 and pivot link 70 to the closed condition.

Figure 8:
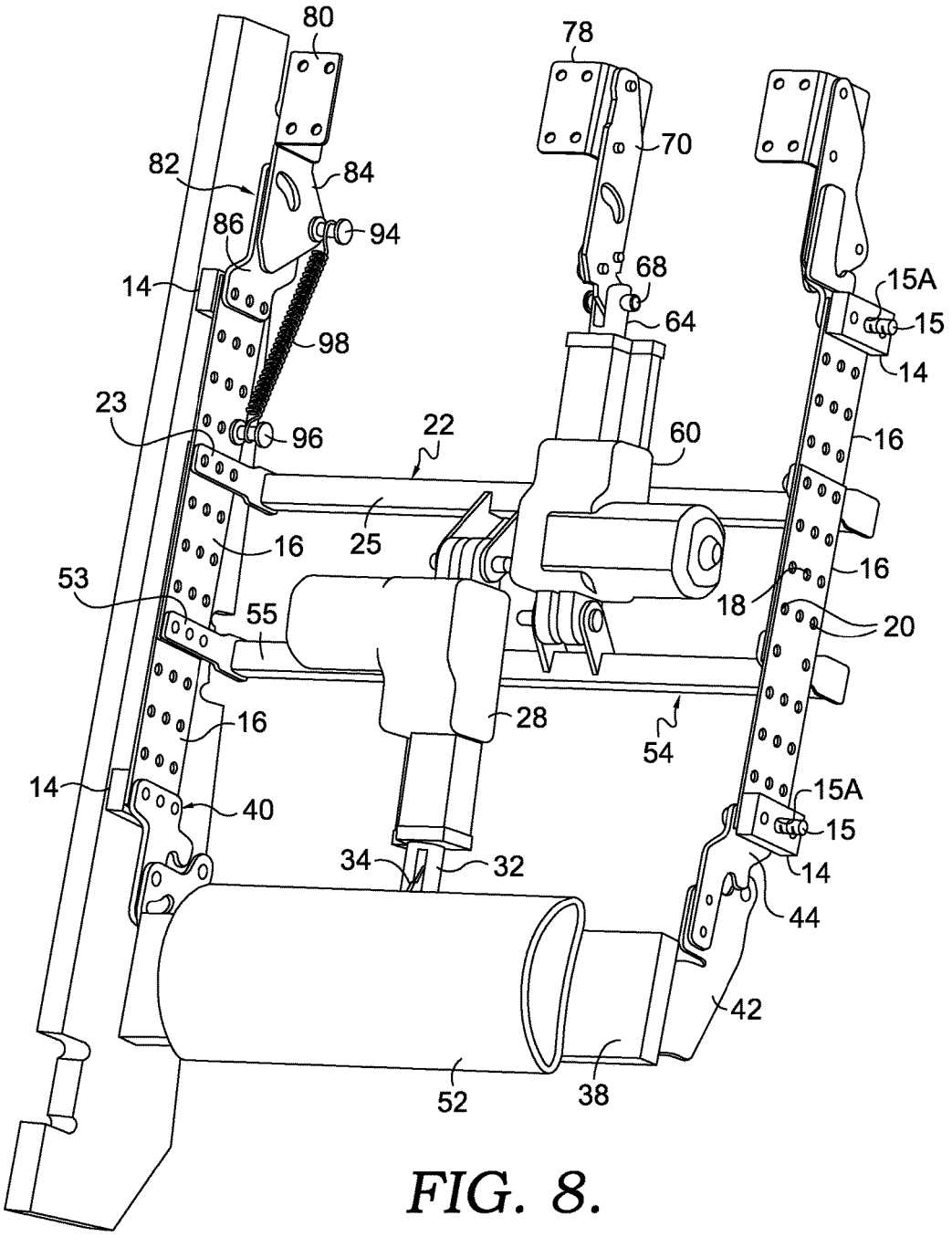
FIG. 8 is a perspective view similar to FIG. 1, showing a large spacing between the lumbar and head tilt area.

The configuration of the assembly 10 as described above allows the assembly 10 to be preconfigured for any of a number of different styles of backs for different seating units. As one example, the configuration shown in FIG. 8 illustrates the lumbar area and the head tilt area being some distance apart. This configuration would be useful, as an example, on a chair having a relatively high (or tall) chair back. The assembly 10 shown in FIG. 8 can be preassembled and delivered to a furniture manufacturer for incorporation. Because the assembly 10 is easily pre-configurable to the specifications of the specific seating unit, the furniture manufacturer can simply install the assembly 10 using only four bolts, through the middle holes 15A of the mounting blocks 14. To configure the assembly, side plates 16 are moveable relative to one another, as can be seen by comparing their relative positions in FIGS. 1, 8, and 9. As shown in FIG. 8, the side plates 16 on each side overlap each other, such that five rows of holes 18, 20 overlap each other. In this configuration, the mounting blocks 14 are placed at the top of one side plate 16, and the bottom of the other side plate 16. At the top, the mounting bolts 15 extend through the lower, center hole of pivot point link 86, through the middle hole 18 of side plate 16, through the hole 15A in the mounting block 14, and threaded into the side frame 12. At the bottom, the mounting bolts 15 extend through the upper, center hole of pivot point link 44, through the middle hole 18 of side plate 16, through the hole 15A in the mounting block 14, and threaded into the side frame 12. The mounting blocks 14 space the assembly 10 away from the side frame 12, providing clearance for the bolts that bolt the side plates 16 to each other, and to the end plates 23 (of the lumbar motor tube assembly 22) and 53 (of the head tilt motor tube assembly). In spacing the head tilt away from the lumbar, it can be seen in FIG. 8 that the lumbar motor tube assembly 22 is closer to the head tilt motor tube assembly 54, as compared to FIG. 9. Preferably, the distance from the lumbar motor tube assembly 22 to the pivot point link 44 is a constant. Similarly, the distance from the head tilt motor tube assembly 54 to the pivot point link 86 is a constant. Based on the design of the seating unit, the lumbar push bar 52 and the head tilt flange brackets 78, 80 can be easily moved up or down along the side plates 16, using the appropriate hardware holes 20. As merely one example, the rows of holes 18, 20 can be spaced at one inch intervals. In addition, different widths of seating units can be accommodated by varying the length of the lumbar motor tube assembly 22 and the head tilt motor tube assembly 54.

Figure 9:
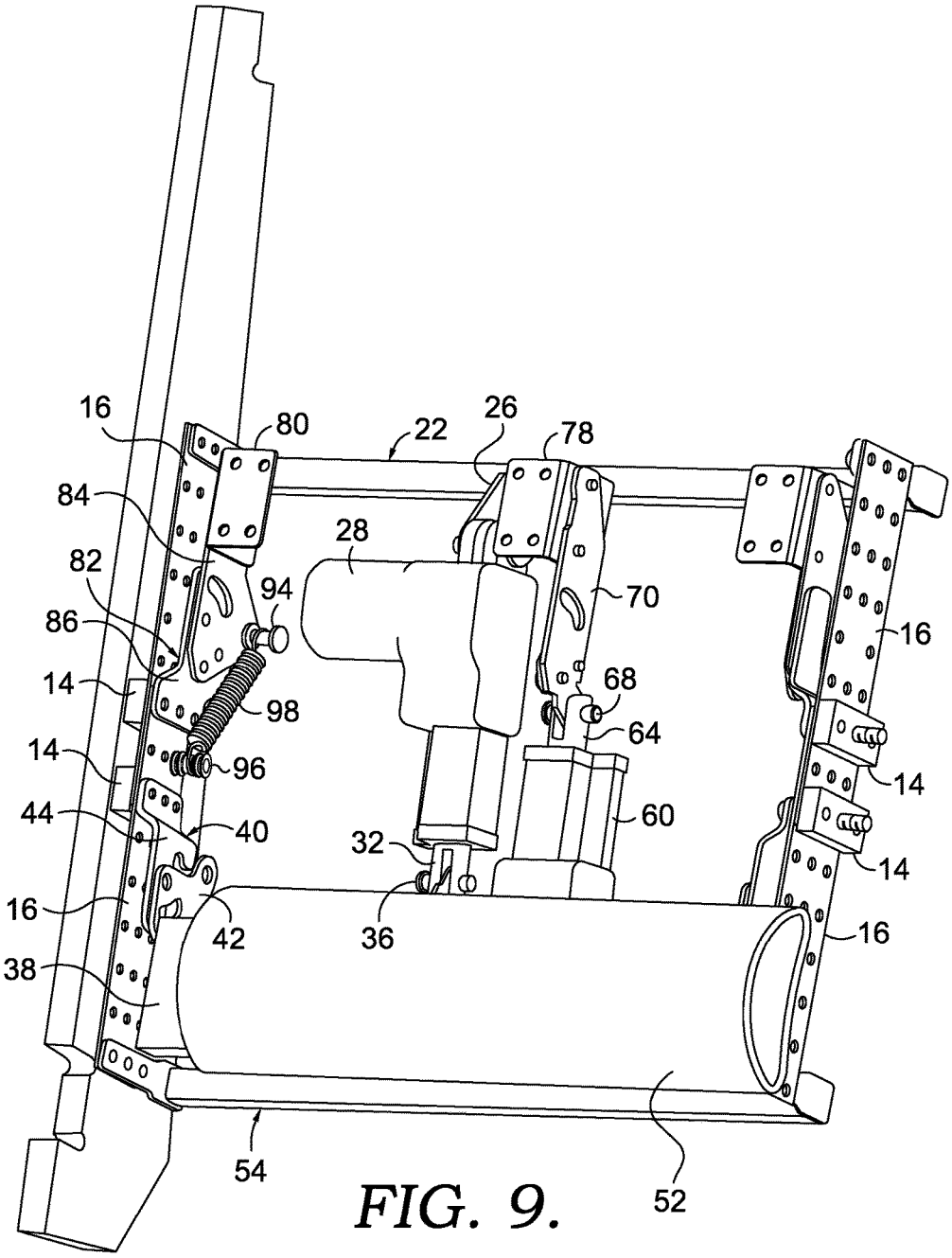
FIG. 9 is a perspective view similar to FIG. 8, but showing a small spacing between the lumbar and head tilt area.

As another example, the configuration shown in FIG. 9 illustrates the lumbar area and the head rest area being much closer together. In the example shown in FIG. 8, the distance (A) between the pivot point link 86 and the pivot point link 44 is much greater than the distance (B) between the pivot point link 86 and the pivot point link 44 of FIG. 9.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A headrest tilt and lumbar support assembly for installation in a back frame, having spaced apart back frame sides, of a seating unit, comprising:

a first pair of side plates having a length, and a series of holes spaced along the length of each side plate, each of the series of holes spaced from one another;

a second pair of side plates spaced from one another, each of the second pair of side plates having a length, and a series of holes spaced along the length of each side plate, wherein one of the series of holes on the first pair of side plates, and one of the series of holes on the second pair of side plates are used to directly couple a respective first side plate to a respective second side plate;

a headrest tilt mechanism coupled to, and between, one of the first or second pair of side plates; and a lumbar support assembly coupled to, and between, the other of the first or second pair of side plates, wherein the first and second pair of side plates are adapted to be coupled to, and between, the spaced apart back frame sides.

2. The assembly of claim 1, wherein the headrest tilt mechanism and the lumbar support assembly are coupled to, and between, the first and second pair of side plates using the series of holes on the first and second side plates.

3. The assembly of claim 2, wherein the series of holes on the first and second side plates includes a row of holes at each spaced location along the length of either the first or second pair of side plates.

4. The assembly of claim 3, wherein each row of holes includes at least 3 holes including an inner hole, a middle hole, and an outer hole, and wherein the inner and outer holes are used to couple the headrest tilt mechanism and the lumbar support assembly to, and between, the respective pairs of first and second side plates.

5. The assembly of claim 4, further comprising a first pair of mounting blocks, wherein each of the first pair of mounting blocks is coupled to, and between, a respective one of the first pair of side plates, and a corresponding back frame side, thereby spacing the first pair of side plates from the adjacent back frame side.

6. The assembly of claim 5, further comprising a second pair of mounting blocks, wherein each of the second pair of mounting blocks is coupled to, and between, a respective one of the second pair of side plates, and a corresponding back frame side, thereby spacing the second pair of side plates from the adjacent back frame side, wherein the assembly is coupled to the back frame sides using the first and second pair of mounting blocks.

7. A headrest tilt and lumbar support assembly for installation in a back frame, having spaced apart back frame sides, of a seating unit, comprising:

a first pair of side plates, spaced from one another;

a second pair of side plates spaced from one another, each of the second pair of side plates being directly coupled to a respective one of the first pair of side plates, each coupled first and second side plate combination having an overall length;

a headrest tilt mechanism coupled to, and between, one of the first or second pair of side plates;

a lumbar support assembly coupled to, and between, the other of the first or second pair of side plates; and a means for adjusting the overall length of each coupled first and second side plate combination, wherein the first and second pair of side plates are adapted to be coupled to, and between, the spaced apart back frame sides.

8. The assembly of claim 7, further comprising a first pair of mounting blocks, wherein each of the first pair of mounting blocks is coupled to, and between, a respective one of the first pair of side plates, and a corresponding back frame side, thereby spacing the first pair of side plates from the adjacent back frame side.

9. The assembly of claim 8, further comprising a second pair of mounting blocks, wherein each of the second pair of mounting blocks is coupled to, and between, a respective one of the second pair of side plates, and a corresponding back frame side, thereby spacing the second pair of side plates from the adjacent back frame side, wherein the assembly is coupled to the back frame sides using the first and second pair of mounting blocks.

* * * * *